United States Patent [19]

Notton

[11] 4,246,083

[45] Jan. 20, 1981

[54] REMOVAL OF SURFACE MATERIAL

[75] Inventor: John H. F. Notton, Reading, England

[73] Assignee: Johnson, Matthey & Co., Limited, London, England

[21] Appl. No.: 70,320

[22] Filed: Aug. 24, 1979

[30] Foreign Application Priority Data

Aug. 31, 1978 [GB] United Kingdom ..... 35189/78

[51] Int. Cl.[3] ..... C25F 5/00

[52] U.S. Cl. ..... 204/146

[58] Field of Search ..... 204/140, 145 F, 146

[56] References Cited

U.S. PATENT DOCUMENTS

| | | | |
|---|---|---|---|
| 3,257,299 | 6/1966 | Mekjean | 204/146 |
| 3,490,999 | 1/1970 | Raviv | 204/146 |

FOREIGN PATENT DOCUMENTS

| | | |
|---|---|---|
| 659927 | 10/1951 | United Kingdom . |
| 666281 | 2/1952 | United Kingdom . |

*Primary Examiner*—T. M. Tufariello

*Attorney, Agent, or Firm*—Cushman, Darby & Cushman

[57] ABSTRACT

The removal of a metal or alloy from the surface of a body, in particular turbine blades, by forming close to as in contact with the surface a one or more other metal or metals which will alloy with the metal or alloy to be removed. By forming the one or more other metals in situ, for example by electrolytic methods, attack of the underlying surface such as occurs when removal is effected by dipping the body in a bath of molten metal, is avoided.

3 Claims, 1 Drawing Figure

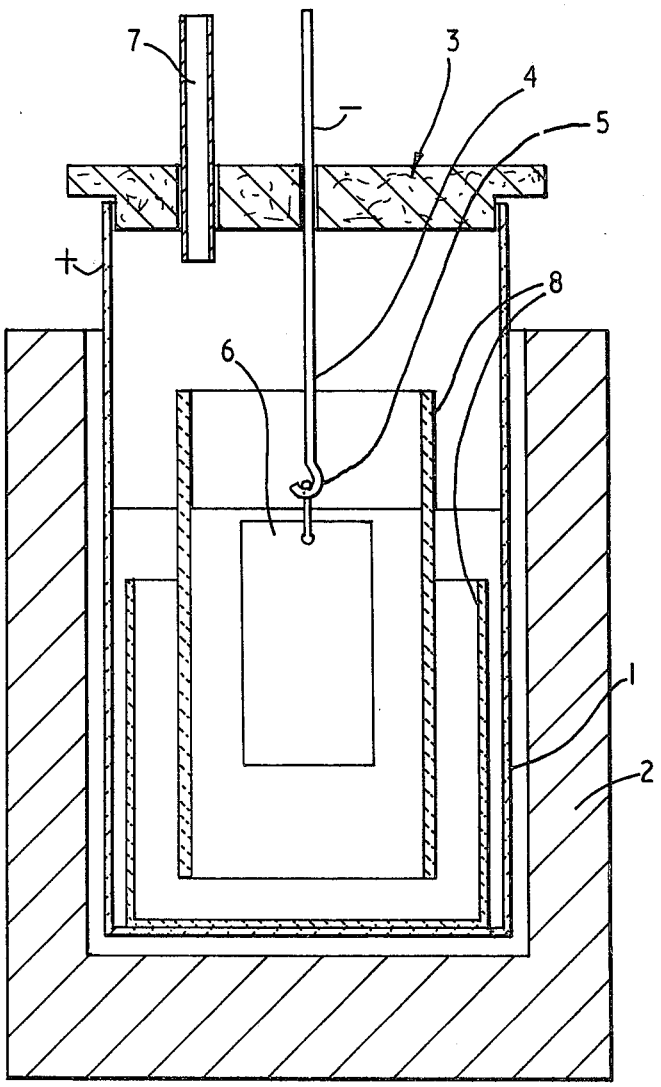
7
3
4
5
−
+
8
6
1
2

REMOVAL OF SURFACE MATERIAL

This invention relates to the removal of surface material and, in particular, the removal of metal and alloy coatings.

It frequently occurs in the production of, for example, metal- or alloy-coated or plated articles that a proportion of them have to be rejected because of imperfections in the coatings and/or for other reasons. If the coatings are of precious metal, such as gold or platinum, it is generally economically worthwhile to recover this metal from the rejected articles and, in those cases where the underlying bodies have relatively small intrinsic value, this may be done by simply dissolving away the material of the bodies so as to leave the material of the coatings substantially unaffected.

In other cases, however the underlying bodies may have considerable intrinsic value, either by reason of the cost of the material from which they are made, or because of certain machining or other fabricating operations to which they have been subjected before the application of the coatings or both. In such cases it is uneconomic to sacrifice the underlying bodies by dissolving them away from the coatings and, if the material of these coatings is to be recovered, means must be employed for removing them from the bodies. Further, in most cases, these means must be such that no significant damage is done to the surfaces of the bodies from which the coatings are removed.

An example, but by no means the only example, of bodies having high intrinsic value by reason of the machining operations to which they have been subjected are aero-engine turbine blades, especially those with complex internal air cooling passages. Such turbine blades may, for example, be made of nickel- or cobalt-based superalloys and, as part of a process of increasing their corrosion resistance, they may be provided with platinum coatings.

Whenever the coatings on blades treated in this way do not reach certain required standards, it is necessary to remove them and to replate the bodies with platinum. When removing the coatings it is very important to avoid damage to and any significant changes in the composition, and hence the properties of the surfaces of the underlying blades. It is also, of course, very desirable to be able to recover any platinum so removed.

The present invention arose out of a series of attempts to develop a process for the removal of platinum coatings from nickel-containing superalloy aero-engine turbine blades which would satisfy the conditions just described.

A number of approaches to the problem were considered and, if deemed practicable, tested. Among the methods considered were:

(a) mechanical abrasion
(b) the use of chemical-stripping agents
(c) electrolytic stripping, and,
(d) the use of liquid metal baths.

Mechanical abrasion was considered too costly and too difficult to control because of the complex shapes to be cleaned of platinum. Further, very little can be done to remove by mechanical abrasion, platinum deposited in any air cooling passageways.

It was known that chemical stripping agents can be used to remove the platinum coatings if they are first "aluminised", that is, if aluminium is first allowed to diffuse into them. A disadvantage of this process, however, is the cost and the near impossibility of preventing the aluminium diffusing into the surfaces of the underlying blades. This means that these surfaces would also, to an extent, be attacked by the stripping agent so that unacceptably large amounts of metal would be removed from the blades.

It is difficult to envisage a chemical reagent that will dissolve platinum and leave nickel- or cobalt-based superalloy untouched. Experiments with aqua-regia and other acids showed that these will attack the platinum-superalloy interface preferentially. They will thus effectively remove the platinum but only after substantial amounts of superalloy have been dissolved.

Electrolytic stripping was tried in the bath of fused KCN and NaCN used for plating the blades, except that the bath did not have the normal addition of a platinum salt, the blades in this case, of course, being made anodic in the bath. This proved unsuccessful because the bare superalloy surfaces from which the platinum layer had been removed were attacked by the cyanide with the production of carbided outer layers which would not replate satisfactorily.

Attention was accordingly turned to the use of liquid metal baths for stripping the platinum from the coated turbine blades. It was considered that low melting point metals which could be shown from the phase diagrams to alloy with platinum could be used to remove the platinum at an appropriate temperature, provided they did not interact chemically or metallurgically with the underlying blades themselves.

The metals lead, tin, indium, cadmium, zinc, bismuth, mercury, the alkali metals and the alkaline earth metals appeared to be suitable, although no information was available on the readiness or otherwise with which these metals would attack the superalloy of the blades themselves.

In the event, cadmium, lead and mercury were not tested because their handling could involve certain toxicity hazards but molten tin, indium, zinc and bismuth were all found to be effective at temperatures below 500° C. in removing the platinum as shown by the results given in the attached Table 1. The temperature of 500° C. was chosen to minimise the attack on the superalloy blades and to prevent changes in their heat treatment condition. A disadvantage of using these metals was that they all diffused into the superalloy blades to a greater or lesser extent and, in practice, the resulting diffusion zones would have to be removed from the blades and this would result in unacceptably large dimensional changes of the blades.

The alkali metals were next considered and, because baths of molten alkali metal, even under inert gas blankets are unnecessarily dangerous, it was decided to use an alkali metal produced electrolytically. Sodium was chosen and the method proved to be highly successful. Subsequent tests have shown it to be workable with other metals than sodium and to be applicable to other coatings metals and substrates than platinum and superalloys.

Accordingly we propose a process for the removal of metal or alloy from a surface which includes the step of forming close to or in contact with the surface, one or more other metals which will alloy with the first-mentioned metal or alloy on the surface.

In a preferred embodiment, the first-mentioned metal or alloy is a layer or coating on the surface of a body formed of a second metal or alloy.

Preferably the process is such that any alloy formed as a result of intersection between the said one or more other metals and the said first metal or alloy.

(i) becomes detached from the body during the process or is easily removeable therefrom during the process or subsequently; and (ii) will permit the first metal or the components of the first alloy readily to be removed from it;

Also, the said one or more other metals preferably, (i) are formed electrolytically close to or in contact with the said layer or coating;

(ii) are formed electrolytically by making the said body cathodic in an electrolyseable melt of a compound or compounds of these one or more other metals; and (iii) are at a temperature above the melting point of any alloy which it or they form with the first metal or alloy.

When the material to be removed is a layer or coating on a body of another material, the said one or more other metals preferably are such that they will not alloy with the second metal or alloy or will only do so to a very limited extent; and the process may be continued until the whole of the said layer or coating is removed from the surface of the said body.

One embodiment of the invention will now be described by way of example with reference to the accompanying drawing which shows diagrammatically a form of heated crucible 1 which is 7.5 cm in diameter and 50 cm deep and is located within a wire-wound furnace 2. The crucible is provided with a Sindanyo lid 3 through which passes a rod 4, which may be raised and lowered and which terminates at its lower end in a hook 5 from which the specimen to be stripped 6 may be suspended. Also passing through the lid 3 is a tube 7 which may be used for the introduction into the crucible of an inert cover gas such as argon or nitrogen. Further, refractory Purox partitions 8 comprising a Purox crucible type XN250 and a length of 4 cm diameter Purox tube are interposed between the specimen 6 and the wall of the nickel crucible 1.

In practice, a 1.5 kg charge of solid sodium hydroxide is introduced into the crucible, inert gas is fed through tube 7, the furnace 2 is switched on and the charge melted and the specimen to be treated, for example a platinum-coated turbine blade, lowered into it. Finally, electric current is passed through the cell with the specimen made cathodic and the crucible anodic as shown in FIG. 1. This process is continued until all the platinum coating has been removed. Thereupon the specimen is lifted out of the molten sodium hydroxide charge, the current supplies to the cell and the furnace 2 are switched off and the charge is allowed to cool.

After being stripped from the specimen, the platinum, in the form of a platinum-sodium alloy with additions of alumina and nickel oxide from the Purox partitions and the material of the crucible respectively, appears as a black powder which settles at the bottom of the fused sodium hydroxide melt and takes no further part in the process. It can easily be removed by filtration after the cooled and solidified melt at the end of the process has been dissolved in water. The platinum may then readily be extracted from the powder by some suitable metallurgical refining or other process.

When platinum-coated zero-engine turbine blades had been treated in the manner just described, no sodium could be detected by microprobe analysis on the surfaces of the stripped blades and metallurgical examination did not show any attack at, for example the grain boundaries.

Weight losses from the stripped blades were very little more than would be expected from the known weight of platinum in the coatings removed. Further, the weight losses were not greatly increased by repeating the stripping treatment on previously stripped blades. On such blades each having surface areas of 34 $cm^2$, the extra weight loss per blade was about 0.05 gm. This worked out at less than $2\mu$ of base metal over the whole area of each blade and may represent the extent of the inter-diffusion between platinum and superalloy which occurs during the fused salt plating process. Including grit blasting to re-prepare the blades for plating, a total weight loss was obtained of about 0.25 gm per blade which corresponds to the removal of about $8\mu$ from the whole area of each blade.

A number of tests were carried out on two groups of platinum-coated blades, referred to for convenience in the following as "A" blades and "B" blades, in order to determine the relationship between the times for total removal of a coating on the one hand and the area to be stripped and stripping current used, on the other. The aim was to provide a means of calculating the total time required to strip a blade and the experimental results are displayed in the attached Table 2.

From the results obtained, and as expected, it was obvious that it takes longer a strip a large blade than a small one for the same current. For a given blade, however, the amount of metal removed is not directly proportionai to time, current or ampere hours. The reason for this became evident on examination of partly stripped blades which revealed bare patches on the blades and showed that stripping had been anything but even.

This suggested that the platinum layer could, to a first approximation, be treated as wedge-shaped, or as a series of wedge-shaped areas. For the purposes of this approach to the problems, the platinum layer at the "beginning" of the or each area to be stripped is assumed to be very thin with a uniform increase in thickness on moving from the beginning to the "end" of the, or each area. Further, the sodium is assumed to be formed uniformly over the whole area of the blade and platinum to be removed uniformly by it. This means that one or more bare areas are formed and grow progressively in size as the platinum is removed. The nett rate of platinum removal then progressively decreases as the area available for attack decreases.

The total stripping time (T) for each test reported in Table 2 was calculated on the basis of this wedge model (with the exception of test B2) and the log T plotted against log I where I is the stripping current. The straight lines obtained suggested a relationship $$T = K_1 A . I^{-K_2}$$

where T and I have the meanings previously assigned to them and A is the area to be stripped.

The results for the "A" and "B" blades gave the following values for the constants:

| | $K_1$ | $K_2$ |
|---|---|---|
| A | 0.3 | 0.94 |
| B | 0.28 | 0.88 |

It would seem, however, that the expression:

$$T=0.3AI^{-1}$$

where $K_1=0.3$ and $K_2=1$ would be sufficiently accurate for many purposes.

Although the invention has been described with reference to the stripping of platinum from platinum-coated aero-engine turbine blades, it is not by any means so limited. It may, for example, be used for removing metal from the outer surface of a body so as to reduce its size, or for the purpose of removing coatings of metals other than platinum from bodies other than turbine blades, provided one or more metals can be formed at or near the outer surface of the body concerned under such conditions that it or they will interact with the material of the said outer surface so as to form an alloy which will become spontaneously detached or which may easily be removed from the body.

TABLE 1

| Stripping with liquid metals | | | | |
|---|---|---|---|---|
| Bath Metal | m.p.t °C. | Bath Temp. °C. | Effectiveness: Platinum removal | Effectiveness: Superalloy attack |
| Tin | 232 | 300 | Almost complete | Yes, detectable with electron microprobe analyser |
| | | 400 | Complete | Severe attack |
| Indinum | 156 | 250 | Pt wetted but not much removed | No attack |
| | | 350 | Almost complete | Severe attack where Pt removed |
| Bismuth | 271 | 400 | Almost complete | Some attack |
| Zinc | 419 | 450 | Complete | Severe attack |

TABLE 2

| Test No. | Temp. °C. | PLATINUM Wt. gms. | PLATINUM Wt. loss gms. | PLATINUM Wt. loss % | Current(I) amps. | Time hrs. | Total stripping time(T) hrs. | Log I | Log T |
|---|---|---|---|---|---|---|---|---|---|
| "A" blades: Surface area = 10cm$^2$ | | | | | | | | | |
| 1 | 380 | 0.1640 | 0.0523 | 31.9 | 0.5 | 1 | 5.71 | −0.30 | 0.76 |
| 1a(rept.) | 480 | 0.1117 | 0.1060 | 94.9 | 4 | 0.42 | 0.51 | 0.60 | −0.29 |
| 2 | 380 | 0.1720 | 0.1438 | 83.6 | 1 | 1.5 | 2.5 | 0 | 0.40 |
| 3 | 380 | 0.1690 | 0.1478 | 87.5 | 2 | 0.92 | 1.42 | 0.30 | 0.15 |
| 4 | 380 | 0.1800 | 0.1108 | 61.6 | 4 | 0.33 | 0.89 | 0.60 | −0.05 |
| "B" blades: Surface area = 34cm$^2$ | | | | | | | | | |
| 1 | 380 | 0.6440 | 0.1699 | 26.4 | 0.5 | 2 | 14.2 | −0.30 | 1.15 |
| 1a(rept.) | 380 | 0.4741 | 0.3375 | 71.2 | 4 | 2 | 4.3 | 0.60 | 0.63 |
| 2 | 380 | 0.5840 | 0.6040 | >100 | 0.5 | 21.3 | 21.3 | −0.30 | 1.32 |
| 4 | 380 | 0.5052 | 0.4892 | 96.8 | 4 | 2 | 2.3 | 0.60 | 0.36 |
| 10 | 480 | 0.7038 | 0.6212 | 88.3 | 4 | 2 | 3.0 | 0.60 | 0.48 |

I claim:

1. A process for stripping platinum from a platinum-coated superalloy body which comprises making the body cathodic in a sodium hydroxide melt whereby sodium is formed electrolytically and forms a readily removable alloy with the platinum without affecting the superalloy body.

2. The process of claim 1 wherein the body is an aero-engine turbine blade.

3. The process of claim 2 carried out under an inert gas atmosphere.

* * * * *